US007078637B2

(12) United States Patent
Lee

(10) Patent No.: US 7,078,637 B2
(45) Date of Patent: Jul. 18, 2006

(54) LOW AIR PRESSURE SWITCH FOR AUTOMOBILE

(75) Inventor: Geon Jong Lee, Jeonju-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/946,022

(22) Filed: Sep. 21, 2004

(65) Prior Publication Data

US 2005/0092586 A1 May 5, 2005

(30) Foreign Application Priority Data

Oct. 30, 2003 (KR) ..... 10-2003-0076147

(51) Int. Cl.
*H01H 35/34* (2006.01)

(52) U.S. Cl. ..... 200/83 R; 200/83 J

(58) Field of Classification Search ..... 200/83 R, 200/83 A, 83 B, 83 J, 83 N, 83 S, 83 W, 200/82 R; 73/717, 723, 745
See application file for complete search history.

(56) References Cited

U.S. PATENT DOCUMENTS

| | | | | | |
|---|---|---|---|---|---|
| 3,553,402 | A | * | 1/1971 | Hire | 200/83 P |
| 4,243,858 | A | * | 1/1981 | Place | 200/83 P |
| 4,459,444 | A | * | 7/1984 | Charboneau | 200/83 P |
| 4,591,677 | A | * | 5/1986 | Hirota et al. | 200/83 J |
| 4,794,214 | A | * | 12/1988 | Sanford | 200/83 P |
| 4,933,517 | A | * | 6/1990 | Yogo | 200/83 J |
| 5,308,939 | A | * | 5/1994 | Sasaki | 200/83 R |
| 5,932,857 | A | * | 8/1999 | Stander et al. | 200/83 B |

* cited by examiner

*Primary Examiner*—Lincoln Donovan
*Assistant Examiner*—M. Fishman
(74) *Attorney, Agent, or Firm*—Morgan Lewis & Bockius LLP

(57) ABSTRACT

A low air pressure switch for an automobile is formed in a water resistance structure in which a connector has an integral terminal and switch body so that a moisture input passage into the interior of a switch is fully disconnected. An air outlet for an air discharge in a spring chamber of the switch body is formed inside the connector and air is discharged trough the interior of the connector and a wire core. Therefore, it is possible to effectively prevent moisture from being introduced into the interior of the switch, so that a reliability and durability of the switch are enhanced.

4 Claims, 2 Drawing Sheets

LOW AIR PRESSURE SWITCH FOR AUTOMOBILE

CROSS REFERENCE TO RELATED APPLICATION(S)

This application is based on, and claims priority from Korean Application No. 2003-0076147, filed Oct. 30, 2003, the disclosure of which is hereby incorporated by reference.

TECHNICAL FIELD OF THE INVENTION

Generally, the present invention relates to a low air pressure switch for an automobile. More particularly, permeation of moisture to the interior of the low air pressure switch is effectively minimized such that the reliability and durability of the low air pressure switch can be enhanced.

BACKGROUND OF THE INVENTION

Typically, a low air pressure switch is adapted for a pneumatic line of large-sized vehicles such as busses, trucks, etc. The low air pressure switch installed in a pneumatic line, for example, a line of a pneumatic brake system, functions to detect a drop in air pressure below a predetermined level. The low air pressure switch is designed to turn on when the air pressure drops below a certain level. An alarming light is turned on in response to the turn-on state of the switch, thereby, generating a sound so that a driver is immediately informed of the drop in air pressure.

A conventional low air pressure switch includes a switch body and a switch cover combined, thus forming a body of the low air pressure switch. The body includes a diaphragm operating in response to air pressure supplied through an air inlet and outlet. A plunger is elastically supported by a spring in cooperation with the diaphragm. A contact plate is provided in a direction opposite to the direction to which the plunger is moved, thus forming a selective on and off contact with respect to the plunger. The air inlet and outlet is engaged to an airline of an automobile and a passage through which air is introduced and released. The diaphragm turns a switch contact point on and off based on a pressure state of air introduced through the air inlet and outlet. A screw assembly is engaged to an air vent block which is engaged to a rear side of the switch cover and is connected by a wire of a connector through a wiring connection member. The connector is connected with a wire harness of the automobile based on a lead wire type.

Therefore, power supplied to the plunger is supplied through the wire of the connector, the wiring connection member, the screw assembly, the air vent block, and the spring. The contact plate is connected with an automobile body through a contact cup and a switch body, thus forming a conduction circuit. In addition, a water resistance rubber cap is engaged from an external side of the switch cover, thus protecting the interior of the switch and the wiring connection portion, thus, in theory, preventing corrosion when moisture is introduced.

In the above-described conventional low air pressure switch, even though the lead wire connection part is protected from moisture by means of a rubber cap, the rubber cap may be corroded and deformed over time and moisture may permeate through a discharge passage of air in the spring chamber along the wire. Thereby, the interior of the switch often becomes corroded, thus losing inherent functions of the switch.

Because the low air pressure switch mainly functions to check air pressure of pneumatic brake systems, the malfunction of the switch can cause a critical problem in safety. Therefore, a certain resolution with respect to the above problem is urgently needed in the industry.

SUMMARY OF THE INVENTION

Embodiments according to the present invention provide a low air pressure switch for an automobile. The low air pressure switch is a water-resistance structure in which a connector, having a terminal and a switch body, are integrally formed so that permeation of moisture into the interior of the switch is prevented. Discharged air passes through the interior of the connector and a wire connected thereto. Therefore, the reliability and durability of the low air pressure switch can be enhanced because the permeation of moisture to the interior of the body of the switch is prevented.

According to an embodiment the low air pressure switch includes a switch body connected with a pneumatic line through an air inlet. A diaphragm operates in response to air pressure introduced through the air inlet and outlet. A contact plate and a plunger form an on and off contact point based on movement of the diaphragm and a spring elastically supports the plunger. A switch cover is combined with the switch body and a connector part is integrally formed with a rear end of the switch cover. A dividing wall is further provided for separating an inner space, defined by the switch cover, into a connector part and a spring chamber. Terminals of the connectors in the spring chamber are connected to the spring and the contact plate, respectively. An air passage communicating the spring chamber and the connector part is formed on the dividing wall for discharging air of the spring chamber of the switch body. Air communicates with the spring chamber and the connector part when the diaphragm moves in response to the change of pressure in the pneumatic system of a vehicle.

BRIEF DESCRIPTION OF THE DRAWINGS

The aforementioned aspects and other features of the present invention will be explained in the following detailed description, taken in conjunction with the accompanying drawings, wherein.

DETAILED DESCRIPTION OF PREFERRED EMBODIMENTS

Figure 1:
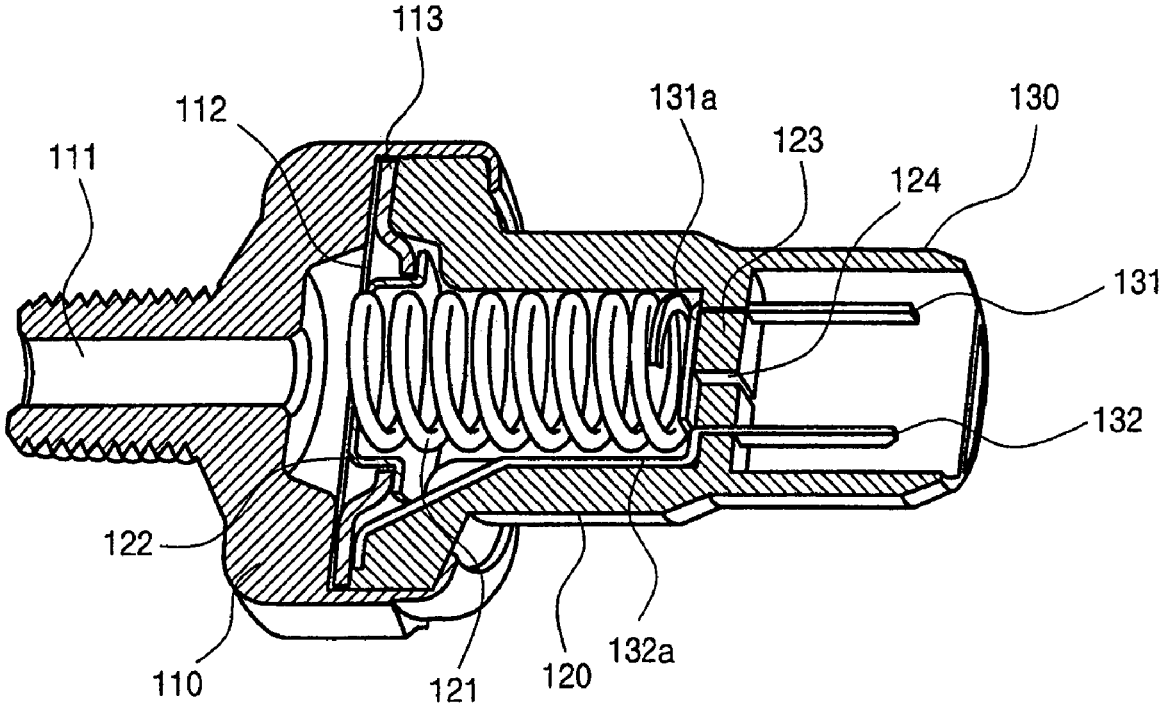
FIG. 1 is a cross-sectional view of a structure of a low air pressure switch illustrating an "on" state of the switch according to an embodiment of the present invention.
Figure 2:
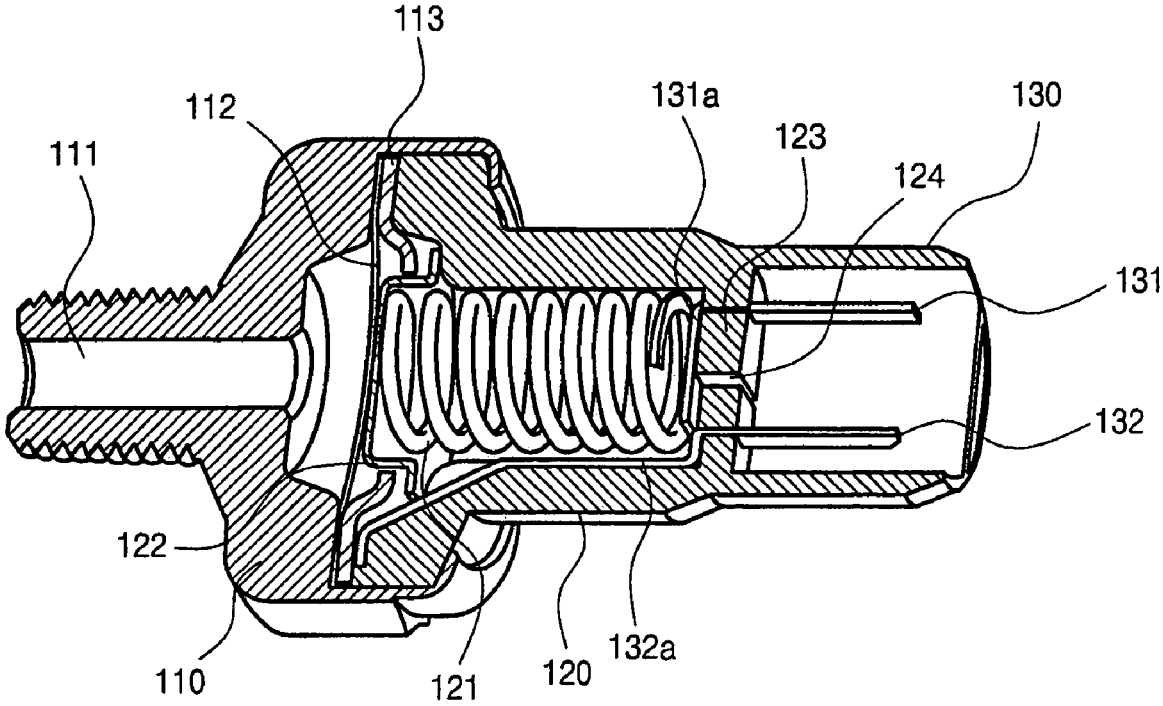
FIG. 2 is another cross-sectional view of a structure of a low air pressure switch illustrating an "off" state of the switch according to an embodiment of the present invention.

According to FIGS. 1 and 2, a switch body 110 and a switch cover 120 are fabricated forming a body of a low air pressure switch. The switch body includes a diaphragm 112 operating in response to a change of air pressure supplied through an air inlet 111, and a plunger 122 that is elastically supported by a spring 121. A contact plate 113 is disposed between the diaphragm 112 and the plunger 122 and selectively contacts the plunger 122 based on movement the plunger 122.

Typically, the air inlet 111 is connected to a pneumatic line of vehicle such as a pneumatic brake system line. The diaphragm 112 turns on and off a switch based on an air pressure state, for example, pressure in the pneumatic line, through the air inlet 111. The spring 121 is provided as an element for determining a predetermined operational pressure of the switch. The spring 121 expands, pushing the diaphragm 112 outwardly when the air pressure in the pneumatic line drops below a predetermined level.

The switch cover 120 is integrally formed with a connector part 130 having connectors 131 and 132 at a rear part thereof. The switch cover 120 and the connector part 130 are integrally molded and fabricated. A dividing wall 123 is formed inside the switch cover 120 and divides the inner space of the switch cover into a spring chamber and a connector chamber. The spring 121 is inserted into the spring chamber and one end thereof is supported by the dividing wall 123. The opposite end of the spring 121 makes contact with a seat formed on the plunger 122 and elastically supports the plunger 122.

An air passage 124 is formed in the dividing wall 123 for communicating the spring chamber with the inner space of the connector part 130. The connector part 130 is coupled with a wire harness of the automobile. A first connector 131 contacts to the spring 121 by means of a first lead 131*a* inserted into the spring chamber through the dividing wall 123. A second connector 132 also passes through the dividing wall 123 and is connected to the contact plate 113 by means of a second lead 132*a* arranged along an inner surface of the switch cover 120. With such an arrangement, the plunger 122, connectors 131, 132, and the spring 121 compose a conductive circuit when an electric power is supplied to the connectors.

As illustrated in FIG. 2, when the air pressure in the pneumatic system, exceeds a predetermined level, the diaphragm 112 and the plunger 122 compress the spring 121 and backwardly move, so that the contact plate 113 is distanced from the plunger 122, whereby the switch is turned off.

As illustrated in FIG. 1, when the air pressure of the pneumatic system, drops below a predetermined level, the diaphragm 112 and the plunger 122 are biased toward the contact plate 113 by means of the spring 121, whereby the contact plate 113 and the plunger 122 make electrical contact with each other, resulting in turning on switch. When the air pressure of the pneumatic line drops below a predetermined level and accordingly the contact plate 113 and the plunger 122 make contact, current flows through a closed-circuit composed of the connectors, the spring 121, the plunger 122 and the contact plate 113, resulting in activation of an alert light, an alarming buzzer, or the like.

The low air pressure switch according to the present invention excludes a wiring connecting element so that the integration of a switch body and the connector part can be accomplished for a water resistance structure. With such an arrangement, the present invention successfully prevents the permeation of moisture into the interior of the switch, whereby corrosion of each element of the switch is prevented and functional loss of the switch is prevented. Furthermore, the low air pressure switch excludes a rubber cap of conventional designs which may corrode and deform as time goes by. Consequently, the present invention is advantageous in that the structure of the switch becomes simple and the number of elements and fabrication cost are reduced.

The on and off operations of the low air pressure switch according to the present invention will now be described. As shown in FIG. 2, in the case that a pneumatic line of the automobile brake system maintains a predetermined level of air pressure, the air pressure applied to the air inlet 111 overcomes the force of the spring 121 and the diaphragm 112 moves the plunger 122 compressing the spring 121. As a result, the plunger 112 comes apart from the contact plate 113, so that the switch is turned off. At this time, the alarming light and buzzer are in an inactive mode, so that the driver can recognize the normal state of the brake air pressure.

According to FIG. 1, when the air pressure in the pneumatic line drops below the predetermined level due to undesirable leakage in the pneumatic brake system, the recovery force of the spring 121 becomes larger than the air pressure applied to the air inlet 111. Therefore, the spring 121 returns the plunger 122 to an initial position such that the plunger 122 makes contact with the contact plate 113, resulting in the switch being turned on. In a state that the switch is on, an alarming light and buzzer operates, such that a driver is informed of the problem in the brake line. Because the air flow through the air passage 124 communicates with surroundings by means of a wire harness coupled to the connector part 130, it dose not cause any disturbance to movement of the diaphragm 112. Additionally, a space is formed in the interior of the connector part 130 such that it is possible to achieve an efficient on and off operation of the switch.

What is claimed is:

1. A low air pressure switch for an automobile, comprising:

a switch body having an air inlet by which the switch body communicates with a pneumatic line of a vehicle;

a diaphragm installed in the switch body, which operates in response to a change of a pressure of air applied to the air inlet;

a plunger closely contacting with the diaphragm, which accordingly moves together with the diaphragm;

a contact plate disposed between the diaphragm and the plunger;

a spring elastically supporting the plunger;

a switch cover encompassing the plunger and the spring;

a dividing wall for separating an inner space of the switch cover into a spring chamber and a connector part; and two connectors located in the connector part, wherein the two connectors are conductively coupled to the spring and the contact plate, respectively;

wherein the plunger electrically contacts the spring and the spring exerts a biasing force on the plunger toward the contact plate, said biasing being resisted by air pressure in the air inlet such that a decreased air pressure causes biasing of the plunger into contact with the contact plate.

2. The low air pressure switch according to claim 1, wherein one of the connectors is conductively coupled to the spring disposed in the spring chamber by a first lead passing through the dividing wall, and the other connector is conductively coupled to the contact plate by means of a second lead arranged along an inner surface of the switch cover.

3. The low air pressure switch according to claim 1, wherein an air passage is further provided in the dividing wall, so that the air can communicate the switch cover and the interior of the connector part when the diaphragm operates.

4. A low air pressure switch, comprising:

a switch body defining an air inlet through which the switch body communicates with a pneumatic line;

a diaphragm positioned within the switch body, said diaphragm operates in response to air pressure applied to the air inlet;

a plunger positioned adjacent the diaphragm, said plunger moving together with the diaphragm;

a contact plate disposed between the diaphragm and the plunger;

a spring elastically supporting the plunger;

a switch cover defining an inner space for encompassing the plunger and the spring;

a dividing wall disposed within the inner space separating the inner space into a spring chamber and a connector part; and at least two connectors located in the connector part, wherein at least one of the connectors is coupled to the spring and wherein at least another connector is coupled to the contact plate;

wherein the plunger electrically contacts the spring and the spring exerts a biasing force on the plunger toward the contact plate, said biasing being resisted by air pressure in the air inlet such that a decreased air pressure causes biasing of the plunger into contact with the contact plate.

* * * * *